United States Patent [19]

Steffens

[11] Patent Number: 4,930,709

[45] Date of Patent: Jun. 5, 1990

[54] CUTTER HEAD FOR CUTTERS

[75] Inventor: Michael Steffens, Remscheid, Fed. Rep. of Germany

[73] Assignee: G. Walter Steffens GmbH & Co., Remscheid, Fed. Rep. of Germany

[21] Appl. No.: 238,559

[22] Filed: Aug. 30, 1988

[30] Foreign Application Priority Data

Sep. 24, 1987 [DE] Fed. Rep. of Germany ..... 3732237

[51] Int. Cl.[5] ..... B02C 18/00

[52] U.S. Cl. ..... 241/282.2; 83/664; 241/292.1

[58] Field of Search ..... 241/282.1, 282.2, 292, 241/292.1; 83/654, 655, 663, 664, 665, 699

[56] References Cited

U.S. PATENT DOCUMENTS 3,730,363 5/1973 Karpf ..... 241/282.1
3,871,590 3/1975 Steffens ..... 241/282.2

FOREIGN PATENT DOCUMENTS 223771 8/1941 Fed. Rep. of Germany ... 241/292.1
594588 11/1947 United Kingdom ..... 241/292.1

*Primary Examiner*—Joseph M. Gorski
*Attorney, Agent, or Firm*—Bromberg & Sunstein

[57] ABSTRACT

In order to be able to position the cutter blades (A, B, C) of a cutter head so that they are radially adjustable in a simple manner in the smallest possible axial space, toothing, (10) is formed in an elongated hole (7) in the area of the blade root (6) at its parallel opposite internal longitudinal edges, whereby toothing (11) at parallel opposite external longitudinal edges of a shaft mounting plate (8) engages with this toothing (10), the shaft mounting plate having a central opening (9), the shape of which corresponds to the cross section of a driven shaft (9'). In this arrangement the thickness of the shaft mounting plate (8) is not greater than the depth of the elongated hole (7), although the length of the shaft mounting plate (8) is smaller than the longitudinal extension of the elongated hole (7).

4 Claims, 2 Drawing Sheets

CUTTER HEAD FOR CUTTERS

Figure 2:
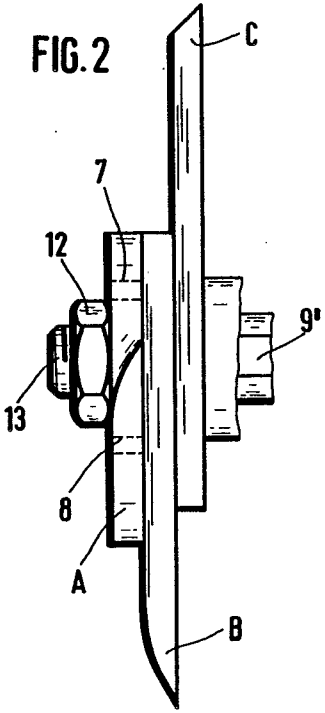

The invention relates to a cutter head for cutters with at least two cutter blades arranged with equilibrium of the masses in relation to its axis of rotation, each of the blades being provided with one elongated hole at the root end and at least one cutting section, with a shaft mounting plate having a central opening in the form of a regular polygon and with toothing formed on opposite parallel longitudinal edges of the shaft mounting plate, which is arranged so that it engages with toothing on opposite parallel longitudinal edges of the cutter blade.

On the cutter head of this type known from German patent specification No. DE-C-2 027 429 the shaft mounting plates have a longitudinal recess with opposite parallel internal edges provided with toothing. The root of the corresponding cutter blade which is provided with corresponding toothing at its opposite parallel external longitudinal edges can be inserted in this longitudinal recess. Although a radial blade adjustment can be provided by means of this toothing, the axial length of the cutter head is very large, as half the thickness of the shaft mounting plate is present between two axially adjacent cutter blades. If a cutter head can be used for a given cutter so that the total axial length of the cutter head no longer allows shaft mounting plates of this type to be positioned between the cutter blades, the radial adjustment and secure mounting which are possible as a result of the toothing must be dispensed with and a complicated system of mounting wth clamping screws and nuts must be used.

The object of the invention is to construct the cutter head of the generic type in such a way that a formclosed radially adjustable positioning and secure mounting of the cutter blade of the cutter head is provided even if the cutter blades are arranged axially directly contiguous to each other.

This object is achieved on the cutter head of the generic type in that the toothing on the external longitudinal edges of the shaft mounting plate and the toothing on the longitudinal edges of the elongated hole of the cutter blade are formed in such a way that the thickness of the shaft mounting plate is not greater than the depth of the elongated hole in the cutter blade and in that the external longitudinal edges of the shaft mounting plate are shorter than the longitudinal edges of the elongated hole.

The provision of toothing at the internal edges at the open end of the recess for the insertion of a square drive shaft with which the external toothing of an equally thick filler plate engages so as to provide for adjustment and safety on a cutter blade with a rectangular recess in the blade root is known from German patent specification No. DE-C-738 472. This is merely an arrangement however whereby a closing part is provided at the recess so as to prevent the ingress of material broken down in the cutter into areas which are difficult to clean, as allowance must be made for the fact that with heavier loads at the root of the blade, the ends of the recess are bent upwards so that the clamping action of the shaft through the filler plate may be jeopardized.

On the cutter head according to the invention the cutter blades can be adjusted in the radial direction according to the spacing of the toothing whilst allowing for the required equilibrium of the masses, and fixed in relation to the drive shaft, whereby to obtain the maximum axial fitting length, the cutter blades can be arranged axially so that they are directly contiguous to each other, as the shaft mounting plate is received in the elongated hole of the associated cutter blade and its thickness corresponds substantially to the depth of the elongated hole.

As the cutter blades are fixed onto the drive shaft by means of the correspondingly shaped opening in the shaft mounting plate they can be made larger at their roots so that a larger gripping surface and thereby a more stable mounting on the drive shaft is achieved. The danger of fracturing the blade is also reduced by means of the large cross section at the transition of the cutting section. Finally the shaft mounting plate can be of square construction so that sets of teeth of another pitch can also be applied to the transverse edges which enables a radial adjustment of for example 3 mm, 1.5 mm and 0.75 mm to be achieved.

Figure 1:
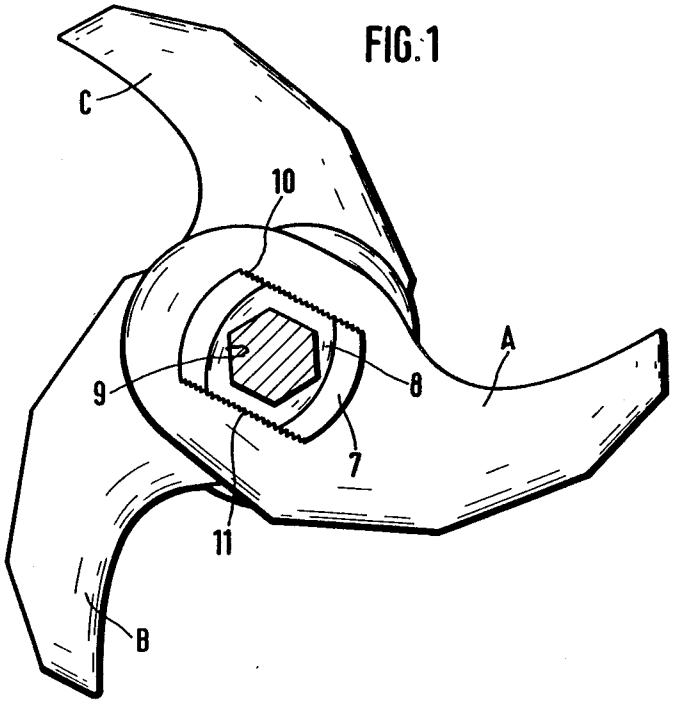
Figure 3:
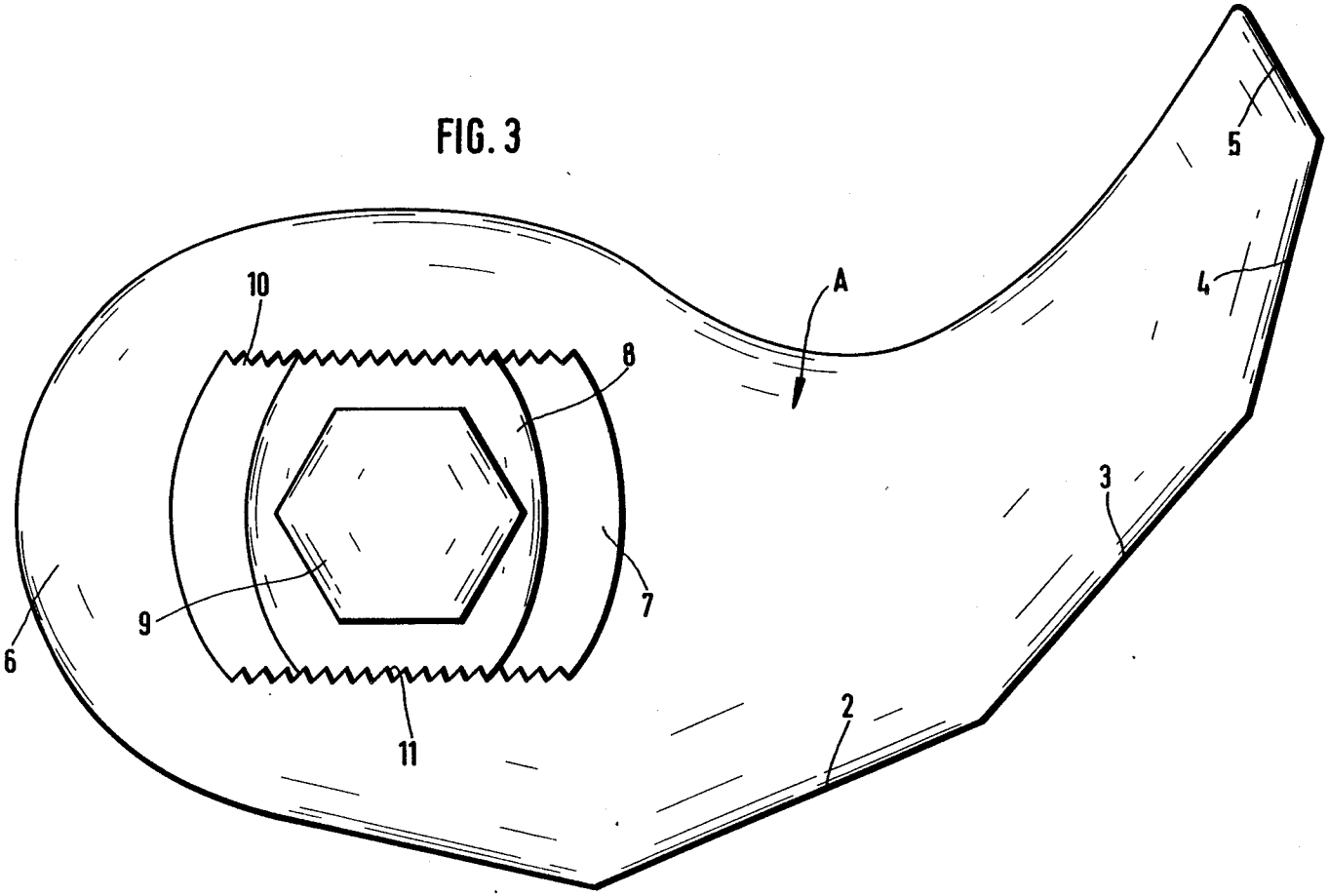

An embodiment of the invention will be described in greater detail on the basis of drawings. The drawings show the following:

FIG. 1 shows a plan view of a cutter head with three cutter blades and cut away drive shaft, FIG. 2 shows a side view of the cutter head of FIG. 1 and FIG. 3 shows a plan view of the front cutter blade of the cutter head of FIG. 1.

The cutter head shown in FIGS. 1 and 2 comprises cutter blades A, B and C which are arranged so that they are directly axially contiguous to each other and on a drive shaft 9' at an angle to each other in each case of 120° and are secured at the shaft head 13 by means of a safety nut 12.

The form of cutter blade A shown individually in FIG. 3 corresponds to cutter blade A of FIG. 1 and is representative of any of cutter blades A, B or C of FIG. 1.

The cutter blade A is provided with cutting sections 2, 3, 4 and 5 and in the area of the blade root 6 an elongated hole 7 is constructed with opposite parallel internal longitudinal edges, which are provided with internal toothing 10.

The opposite parallel external longitudinal edges of a shaft mounting plate 8 with a central hexagonal opening 9 for receiving a drive shaft 9' of corresponding hexagonal shape are provided with external toothing 11 which is constructed for engagement with toothng 10 at the longitudinal edges of the elongated hole 7, so that a radial adjustment of the cutter blade A can be achieved in relation to the central opening 9 of the shaft mounting plate 8 and thus in relation to the drive shaft 9' by the tooth pitch provided.

The longitudinal extension of the shaft mounting plate 8 is smaller than the extension of the elongated hole 7 in its longitudinal direction so as to provide for the radial adjustment over a certain longitudinal range, which is required as a result of regrinding and the balanced positioning of the cutter blade.

The thickness of the shaft mounting plate 8 corresponds substantially to the thickness of the cutter blade A in the area of the blade root 6, i.e. to the depth of the elongated hole 7 so that when the shaft mounting plate 8 is arranged in its corresponding cutter blade, the cutter head consists of components which are arranged in a compact contiguous arrangement with each other.

What is claimed is:

1. A cutter head comprising:

at least two blades, each blade having a blade portion and a root portion, such portions being integral with each other, said root portion having wall portions including facing inner parallel wall portions defining an elongate hole, and said parallel wall portions having teeth formed thereon; and a mounting plate for each blade, each of said plates having two opposite parallel first edges with teeth formed thereon for engagement with the teeth of said parallel wall portions, and further having connection means to connect each of said plates for driving engagement with a drive shaft;

wherein the thickness of each of said mounting plates is not greater than the thickness of a respective blade root portion and the length of said parallel wall portions is greater than the length of said first edges.

2. The cutter head according to claim 1 wherein said connection means comprise wall portions defining a regular polygonal aperture for driving engagement with a corresponding polygonal portion of a drive shaft.

3. The cutter head according to claim 1 wherein the cutter head has three equispaced blades, said connection means comprising wall portions defining a regular hexagonal aperture for driving engagement with a corresponding hexagonal portion of a drive shaft.

4. The cutter head according to claim 1 wherein each of said mounting plates is square and has two opposite parallel second edges wth teeth formed thereon, the teeth of said second edges being of a different pitch to the teeth of said first edges.

* * * * *

UNITED STATES PATENT AND TRADEMARK OFFICE

CERTIFICATE OF CORRECTION

PATENT NO. : 4,930,709

DATED : June 5, 1990

INVENTOR(S) : Michael Steffens

It is certified that error appears in the above—identified patent and that said Letters Patent is hereby corrected as shown below:

col. 1, line 68 - col. 2, line 1: the word "maximum" should be changed to "minimum"

Signed and Sealed this

Eighteenth Day of August, 1992

*Attest:*

DOUGLAS B. COMER

*Attesting Officer*

*Acting Commissioner of Patents and Trademarks*